US005295607A

United States Patent [19]

Chang

[11] Patent Number: 5,295,607

[45] Date of Patent: Mar. 22, 1994

[54] TRASH TANK

[75] Inventor: Der-Feng Chang, Ping-Tung Hsien, Taiwan

[73] Assignee: Chin-Chiao Chou, Ping-Tung Hsien, Taiwan

[21] Appl. No.: 98,987

[22] Filed: Jul. 29, 1993

[51] Int. Cl.[5] ..... B65F 1/06

[52] U.S. Cl. ..... 220/407; 220/263; 220/264; 220/908

[58] Field of Search ..... 220/407, 404, 908, 263, 220/264; 242/55.53

[56] References Cited

U.S. PATENT DOCUMENTS 3,451,453 6/1969 Heck ..... 220/407
4,239,164 12/1980 Barnsbee et al. ..... 242/55.53
4,721,226 1/1988 Yurko ..... 220/407
4,850,507 7/1989 Lemongelli et al. ..... 220/407
4,850,508 7/1989 Lee ..... 220/407
5,213,228 5/1993 Chang .

*Primary Examiner*—Allan N. Shoop
*Assistant Examiner*—S. Castellano
*Attorney, Agent, or Firm*—Lowe, Price, LeBlanc & Becker

[57] ABSTRACT

A trash tank includes a tank body having an open top, a closed bottom, a horizontally extending slot, and a receiving space. A hollow casing is connected detachably to the tank body adjacent to the horizontally extending slot of the tank body. The hollow casing may receive a rolled-up strip of garbage sacks and has a slit which is communicated with the horizontally extending slot of the tank body.

7 Claims, 5 Drawing Sheets

TRASH TANK

BACKGROUND OF THE INVENTION

1. Field of the Invention

This invention relates to a trash tank, more particularly to a trash tank in which fresh garbage sacks are available when needed.

2. Description of the Related Art

Conventionally, garbage sacks are disposed in trash tanks in order to protect the trash tanks from being contaminated. When the garbage sack is full and has to be taken out of the trash tank so as to be replaced by a new sack, the new sack is usually not available. This inconveniences the user.

SUMMARY OF THE INVENTION

It is therefore a main object of this invention to provide a trash tank in which fresh garbage sacks are available when needed.

Accordingly, a trash tank of this invention comprises:

a tank body having an open top, a closed bottom, a horizontally extending slot, and a receiving space that is adapted to receive a garbage sack with a mouth disposed on a periphery of the open top of the tank body; and a hollow casing connected detachably to the tank body adjacent to the horizontally extending slot of the tank body, the hollow casing being adapted to receive arolled-up strip of garbage sacks and having a slit which is communicated with the horizontally extending slot of the tank body.

Other features and advantages of this invention will become apparent in the following detailed description .of the preferred embodiments of this invention with reference to the accompanying drawings.

DETAILED DESCRIPTION OF THE PREFERRED EMBODIMENTS

Figure 1:
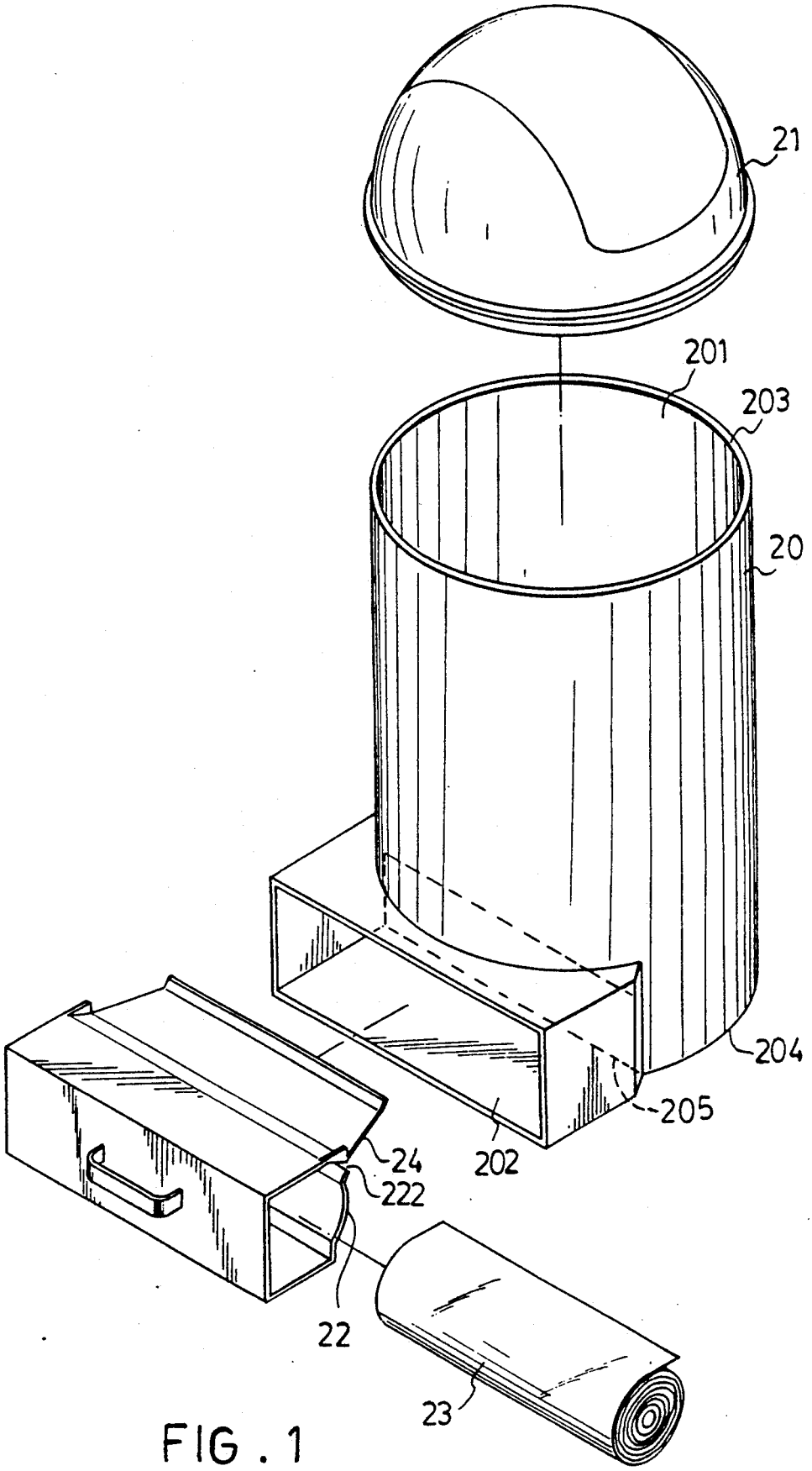
FIG. 1 is a perspective exploded view of a first preferred embodiment of a trash tank of this invention.
Figure 2:
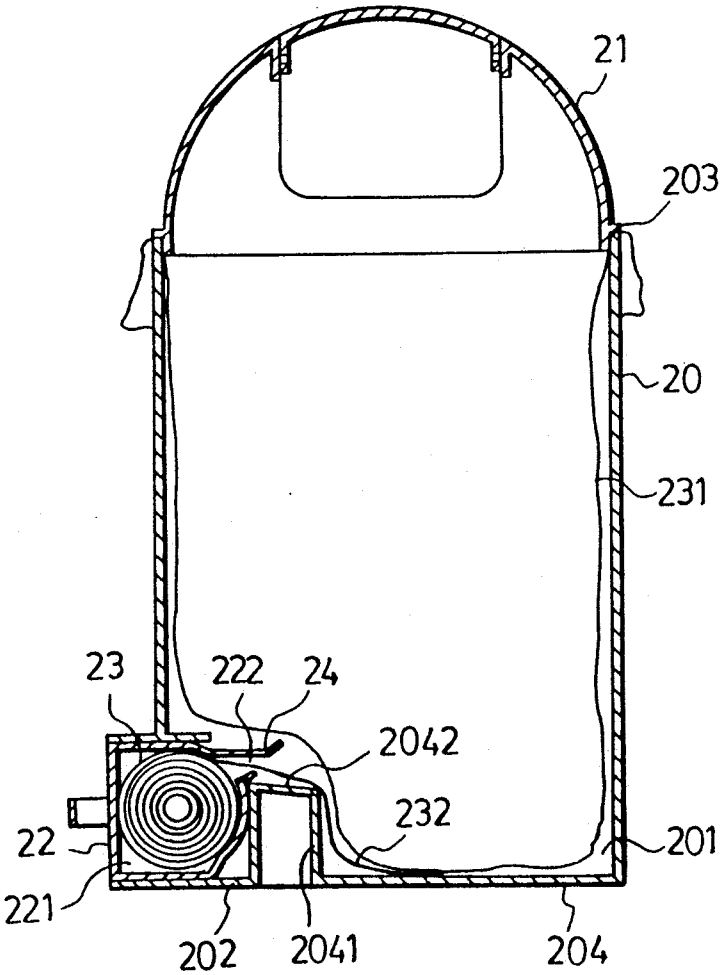
FIG. 2 is a sectional view of the first preferred embodiment of the trash tank of this invention.

FIG. 1 shows a perspective exploded view of a first preferred embodiment of a trash tank of this invention. The trash tank comprises a tank body 20 which has an open top 203, a closed bottom 204, a horizontally extending slot 205, and a receiving space 201 that is adapted to receive a garbage sack 23 with a mouth disposed on a periphery of the open top 203 of the tank body 20, as best illustrated in FIG. 2. A lid 21 is detachably provided on the open top 203 of the tank body 20. A hollow mounting frame 202 is fixed near the closed bottom 204 of the tank body 20. The internal space of the hollow mounting frame 202 is communicated with the slot 205.

A hollow casing 22 is fitted detachably into the hollow mounting frame 202 of the tank body 20. The internal space 221 of the hollow casing 22 is adapted to receive a rolled-up strip of garbage sacks 23 which has transverse perforations for tearing off the individual sacks one at a time, and which may be obtained from commercial sources. The hollow casing 22 has a slit 222 which is communicated with the horizontally extending slot 205 of the tank body 20. Therefore, the garbage sacks 23 can pass through the slit 222 of the hollow casing 22 and the slot 20 of the tank body 20 and into the receiving space 201 of the tank body 20 so that the mouth of the leading garbage sack 231 may be disposed on the periphery of the open top 203 of the tank body 20. The slit 222 of the hollow casing 22 is displaced from the closed bottom 204 of the tank body 20 at a predetermined height, as best illustrated in FIG. 2. The closed bottom 204 has a projection 2041 with an inclined top face 2042 adjacent to the slit 222 of the hollow casing 22. The hollow casing 22 has a flap 24 extending into the receiving space 201 of the tank body 20 above the slit 222 of the hollow casing 22and above the inclined top face 2024 of the projection 2041.

When the leading garbage sack 231 is full and has to be taken out of the trash tank so as to be replaced by a new sack, the mouth of the leading garbage sack 231 is constricted and tied up in a conventional manner, such as with the use of a twine, wire or a clip. The leading garbage sack 231 is then pulled out of the trash tank and the succeeding garbage sack 232 is drawn up by the leading garbage sack 231. The user can separate the leading garbage 231 from the succeeding garbage sack 232 by tearing the transverse perforations between the leading and succeeding garbage sacks, 231 and 232. The succeeding garbage 232 can be disposed on the tank body 20 in a manner similar to that of the leading garbage sack 231. The flap 24 and the inclined top face 204 of the projection 2041 are designed to prevent the rolled-up strip of garbage sack 23 from being contaminated by liquids which may leak out of the leading garbage sack 231 when the garbage sack 231 has apertures or holes formed therein.

Figure 3:
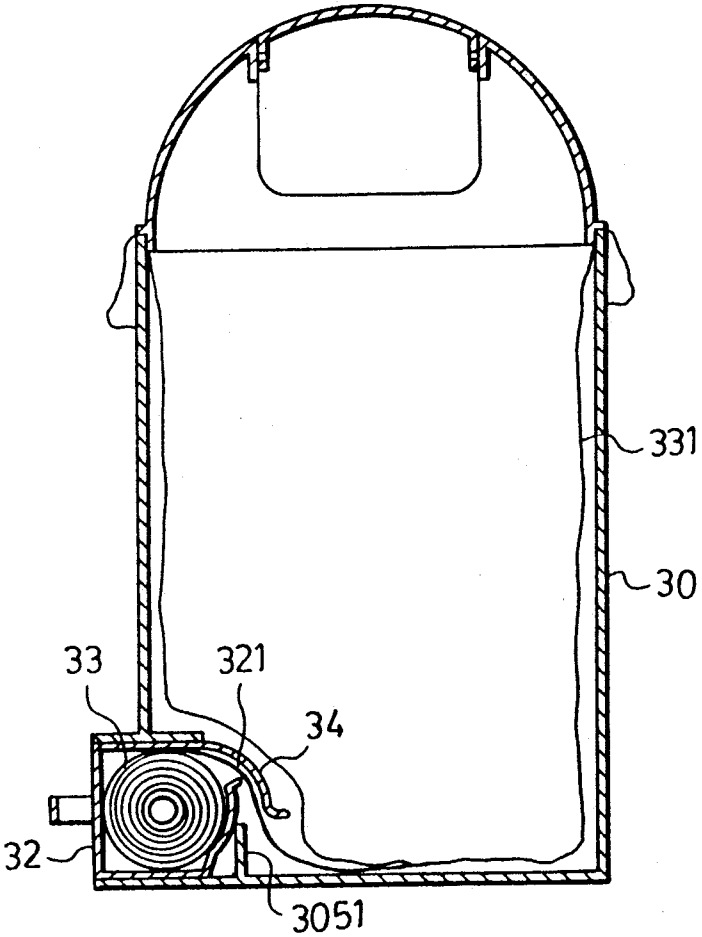
FIG. 3 is a sectional view of a second preferred embodiment of the trash tank of this invention.

FIG. 3 shows a sectional view of a second preferred embodiment of the trash tank of this invention. In this embodiment, the structures of the tank body 30 and the hollow casing 32 are similar to those of the tank body 20 and the hollow casing 22 of the first embodiment except that a partition plate 3051 is formed on the closed bottom of the tank body 30 instead of the projection 2051 of the first embodiment, and that the hollow casing 32 has a curved flap 34 extending downward into the tank body 30 in order to shield the silt 321 of the hollow casing 32 and to protect the rolled-up strip of garbage sacks 33 from being contaminated by the liquid which leaks out of the leading garbage sack 331.

Figure 5:
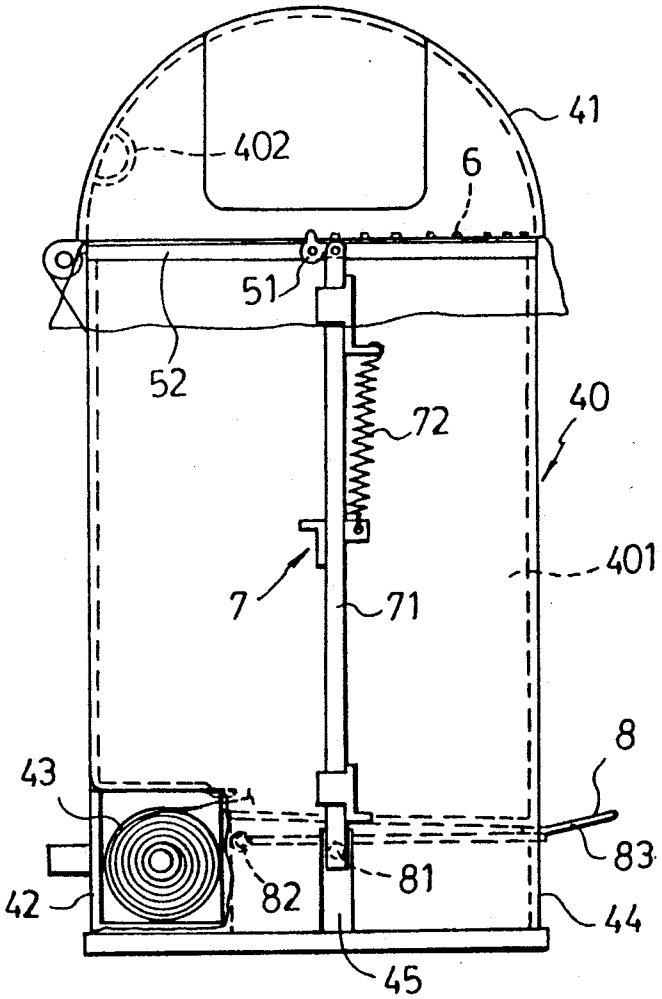
FIG. 5 is a side view of the third preferred embodiment of the trash tank of this invention.
Figure 4:
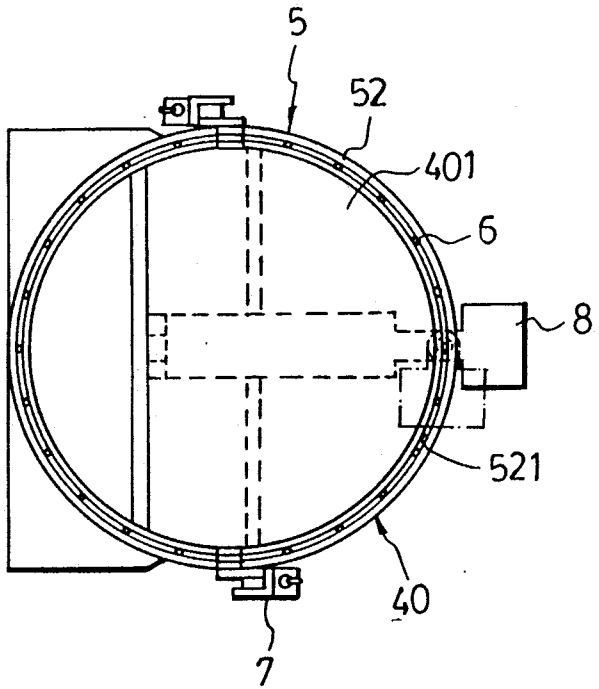
FIG. 4 is a top view of a third preferred embodiment of the trash tank of this invention.

FIGS. 4 and 5 illustrate a third preferred embodiment of the trash tank of this invention which comprises a tank body 40 having a receiving space 401, a lid 40 hinged to the tank body 40, a hollow casing 42 connected detachably to the tank body, and a rolled-up strip of garbage sacks 43 provided in the hollow casing 42 in the aforementioned manner. The trash tank further comprises a clamping means 5 for clamping detachably the mouth of the garbage sack 431, a fastening means 6 for fastening the mouth of the garbage sack 431 after the clamping means 5 is detached from the mouth of the garbage sack 431, an actuating means 7 for actuating the clamping means 5, and a pedal member 8 connected to the actuating means 7 in order to actuate the actuating means 7. The clamping means 5 is disposed on the open top of the tank body 40. A protrusion 402 is formed on the lid 40 and is pushed by the clamping means 5 in order to open the lid 40. The clamping means 5 includes two L-shaped linking arms 51 respectively and diametrically pivoted to the periphery of the open top. Only one of the linking arms 51 is visible in the drawings. A pair of semi-circular clamping members 52 are respectively connected to the linking arms 51. The clamping members 51 are disposed on the open top and cooperatively form a circle. Each of the clamping members 52 has a groove 521 on which the fastening means 6 is disposed, thus enabling the fastening means 6 to fasten the mouth of the garbage sack 431 The disposition and clamping action of the fastening means 6 are disclosed in the applicant's U.S. Pat. No. 5,213,228 and will not be described in detail.

Referring again to FIGS. 4 and 5, the pedal member 8 has a first end 82 pivoted to an internal wall of the tank body 40 near the closed bottom and a second end 83 extending out of a vertical hole 44 of the tank body 40. The actuating means 7 includes a press rod 81 which crosses with and which is disposed below the pedal member 8. The press rod 81 has two ends extending out of two opposed vertically extending holes 45 near the closed bottom of the tank body 40. Only one of the holes 45 is visible in the drawings. A pair of linking rods 71 are provided diametrically on the outside of the tank body 40, as shown in FIG. 5. Each of the linking rods 71 has a lower end connected to the press rod 81 and a spring member 72 which has a first end connected to the tank body 40 and a second end connected to the linking rod 71. The press rod 81 and the clamping members 52 can be maintained in a normal position by the restoring force of the spring members 72, as best illustrated in FIG. 5. The structures and the functions of the tank body 40 and the hollow casing 43 are similar to those of the tank body and the hollow casing of the second embodiment.

Figure 6:
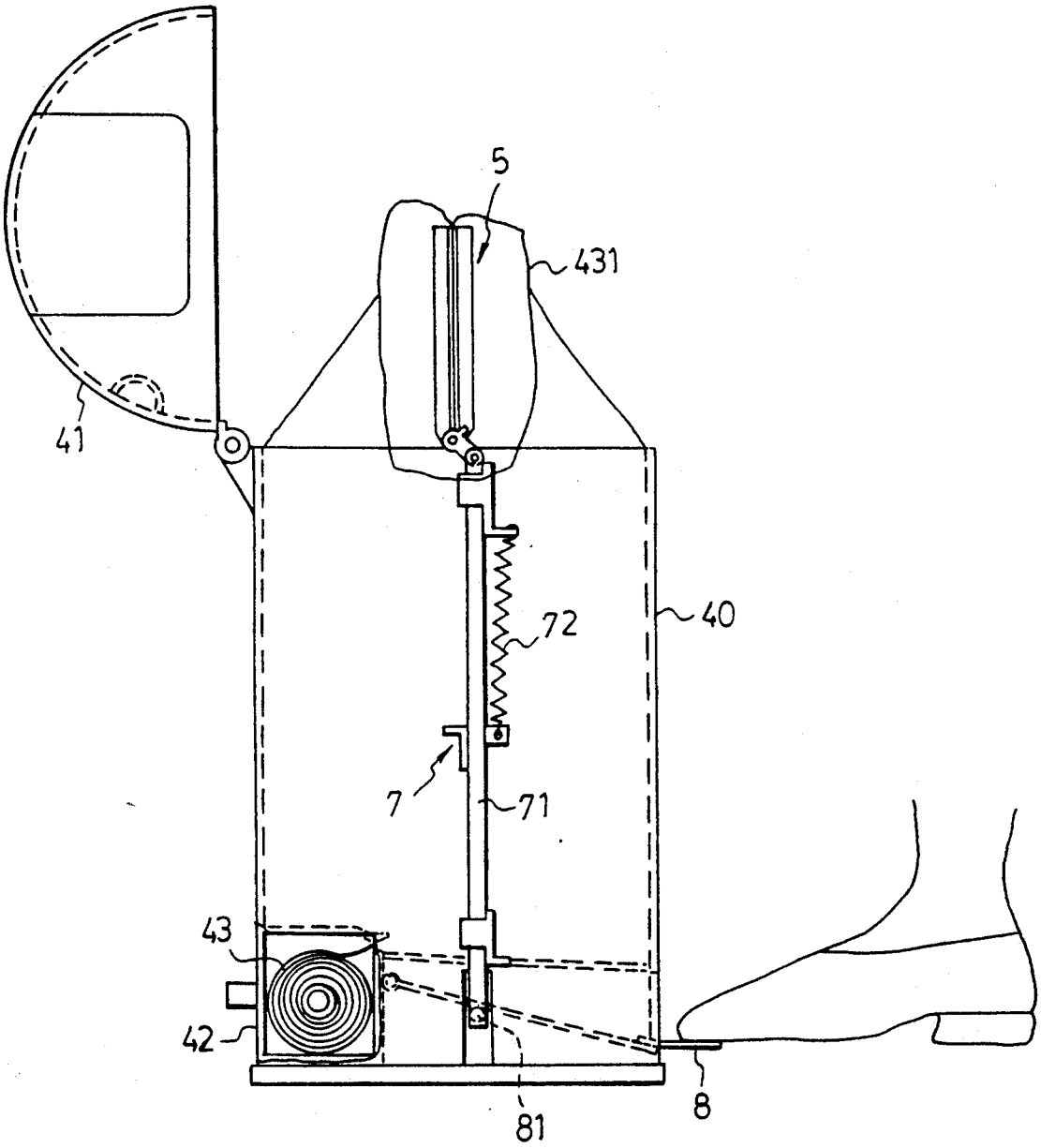
FIG. 6 is a schematic view illustrating the third preferred embodiment of the trash tank of this invention when in use.

When using the third preferred embodiment of the trash tank of this invention, the fastening means 6 are disposed on the clamping members 52 of the clamping means 5, and the leading garbage sack 431 is drawn from the hollow casing 42 and is disposed on the tank body 40 in a manner described hereinbefore, as best illustrated in FIG. 5. When the leading garbage sack 431 is full, the user can apply pressure on the pedal member 8 in order to depress the press rod 81 downward and cause the linking rods 71 to move downward. The linking arms 51 will be driven to enable the clamping members 52 to clamp toward one another. The mouth of the leading garbage sack 431 can thus be fastened by the fastening means 6, as best illustrated in FIG. 6. After the mouth of the leading garbage sack 431 is sealed, the user may release the pedal member 8 and allow the clamping member 52 and the linking rods 71 to move to their normal positions by the restoring force of the spring members 72. The leading garbage sack 431 is then removed from the tank body 40 and is separated from the succeeding garbage sack. The succeeding garbage sack ins then disposed on the tank body 40 in the same manner as the leading garbage sack 431. The second end 83 of the pedal member 8 may be rotated to retract into the tank body 40, as shown by the phantom lines in FIG. 4, in order to protect the user from being injured due to accidental impact.

Figure 7:
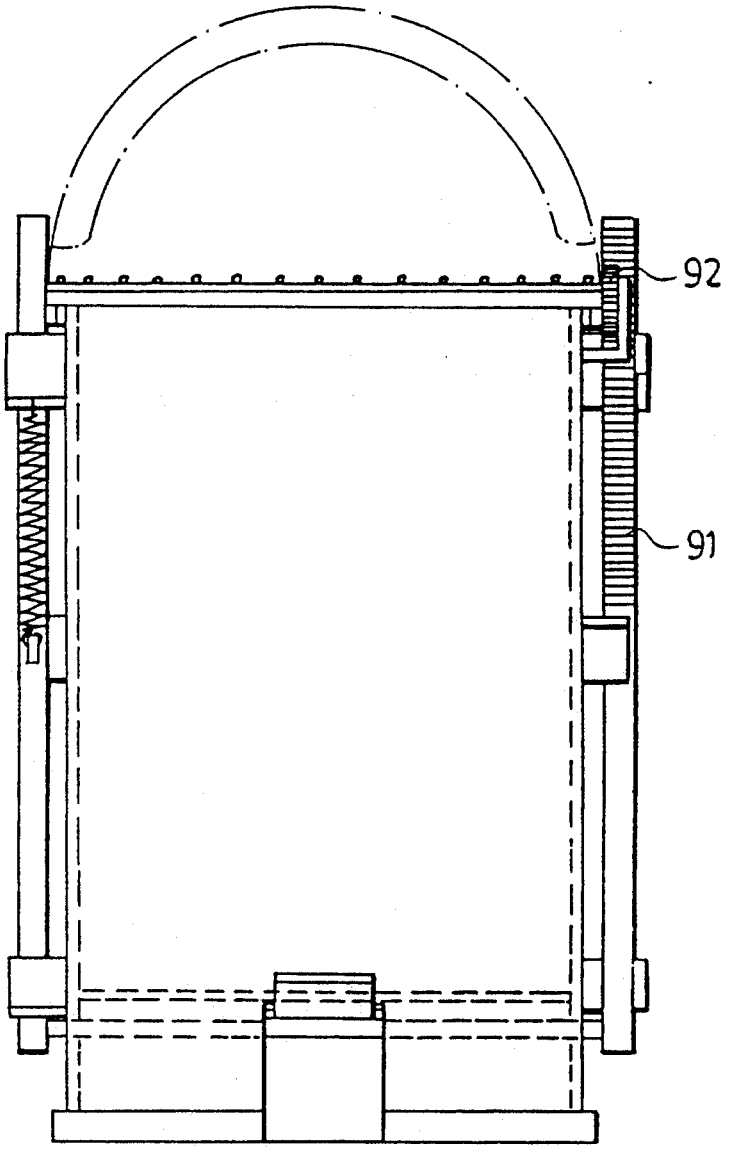
FIG. 7 is a side view of a fourth preferred embodiment of the trash tank of this invention.

The linking rods 71 and the linking arms 51 of the actuating means 7 may be replaced by gear racks 91 and gears 92, as shown in FIG. 7. The structures and the operations of the gear racks 91 and the gear 92 are disclosed in the applicant's U.S. Pat. No. 5,213,228 and will not be described in detail.

It is noted that the trash tank of this invention has the following advantages: (1) When a garbage sack is full and has to be taken out of the trash tank of this invention, a new garbage is readily available by pulling the garbage sacks out of the hollow casing. (2) The user's hand can be prevented from being contaminated when fastening the mouth of the garbage sack by simply applying pressure on the pedal member.

With this invention thus explained, it is apparent that numerous modifications and variations can be made without departing from the scope and spirit of this invention. It is therefore intended that this invention be limited only as indicated in the appended claims.

I claim:

1. A trash tank comprising:

a tank body having an open top, a closed bottom, a sidewall, a horizontally extending slot in said sidewall, and a receiving space that is adapted to receive a garbage sack with a mouth disposed on a periphery of said open top of said tank body; and a hollow casing connected detachably to said tank body adjacent to said horizontally extending slot of said tank body, said hollow casing being adapted to receive a rolled-up strip of garbage sacks and having a slit which is parallel and juxtaposed with said horizontally extending slot of said tank body.

2. A trash tank as claimed in claim 1, wherein said horizontally extending slot is formed adjacent to said closed bottom, said slit of said hollow casing being disposed from said closed bottom at a predetermined height, said closed bottom having a projection with an inclined top face adjacent to said slit of said hollow casing.

3. A trash tank as claimed in claim 1, wherein said hollow casing has a flap extending into said receiving space of said tank body above said slit of said hollow casing.

4. A trash tank as claimed in claim 1, wherein said open top of said tank body has a lid provided thereon.

5. A trash tank as claimed in claim 4, wherein said tank body includes means for clamping detachably said mouth of said garbage sack, said clamping means being disposed on said open top of said tank body; means for fastening said mouth of said garbage sack after said clamping means is detached from said mouth of said garbage sack; means for actuating said clamping means; a pedal member connected to said actuating means in order to actuate said actuating means; and a protrusion formed on said lid and pushed by said clamping means in order to open said lid.

6. A trash tank as claimed in claim 5, wherein said clamping means includes two L-shaped linking arms respectively and diametrically pivoted to said periphery of said open top, and a pair of semi-circular clamping members respectively connected to said linking arms, said clamping members being disposed on said open top and cooperatively forming a circle, each of said clamping members having a groove on which said fastening means is disposed to permit said fastening means to fasten said mouth of said garbage sack.

7. A trash tank as claimed in claim 5, wherein said pedal member has a first end pivoted to an internal wall of said tank body near said closed bottom and a second end extending out of a vertical hole of said tank body; and wherein said actuating means includes a press rod which crosses with and which is disposed below said pedal member, said press rod having two ends extending out of two opposed vertically extending holes near said closed bottom of said tank body; a linking rod having a lower end connected to said press rod; and a spring member which has a first end connected to said tank body and a second end connected to said linking rod.

* * * * *